US008109086B2

(12) United States Patent
Yatsuzuka et al.

(10) Patent No.: US 8,109,086 B2
(45) Date of Patent: Feb. 7, 2012

(54) EXTERNAL COMBUSTION ENGINE

(75) Inventors: Shinichi Yatsuzuka, Nagoya (JP); Takashi Kaneko, Nagoya (JP); Shuzo Oda, Kariya (JP); Toyohiro Kano, Nissin (JP)

(73) Assignee: Denso Corporation, Kariya (JP)

( * ) Notice: Subject to any disclaimer, the term of this patent is extended or adjusted under 35 U.S.C. 154(b) by 343 days.

(21) Appl. No.: 12/454,158

(22) Filed: May 13, 2009

(65) Prior Publication Data

US 2009/0288411 A1 Nov. 26, 2009

(30) Foreign Application Priority Data

May 23, 2008 (JP) ..... 2008-135281

(51) Int. Cl.

| | |
|---|---|
| ***F02G 1/04*** | (2006.01) |
| ***F03C 1/00*** | (2006.01) |
| ***F01K 23/06*** | (2006.01) |
| ***F02C 5/00*** | (2006.01) |

(52) U.S. Cl. ..... 60/508; 60/531; 60/670; 60/39.6

(58) Field of Classification Search ..... 60/508, 60/514, 531, 652

See application file for complete search history.

(56) References Cited

U.S. PATENT DOCUMENTS

2007/0220888 A1 9/2007 Komaki et al.

FOREIGN PATENT DOCUMENTS

| | | |
|---|---|---|
| JP | 54-087329 | 7/1979 |
| JP | 2001-193952 | * 7/2001 |
| JP | 2007-255259 | * 10/2007 |

OTHER PUBLICATIONS

Office action dated Dec. 15, 2009 in corresponding Japanese Application No. 2008-135281.

* cited by examiner

*Primary Examiner* — Thomas Denion
*Assistant Examiner* — Christopher Jetton
(74) *Attorney, Agent, or Firm* — Harness, Dickey & Pierce, PLC

(57) ABSTRACT

An external combustion engine provided with a main container in which a working fluid is sealed flowable in a liquid phase state, a heater heating part of the liquid phase state working fluid in the main container to make it vaporize, a cooler cooling steam of the working fluid heated and vaporized by the heater so as to make it liquefy, an output part converting displacement of the liquid part of the working fluid caused by a change of volume of the steam into mechanical energy and outputting the energy, an auxiliary container communicated with the main container through a venturi means and having a liquid sealed inside it, an auxiliary heater heating the liquid in the auxiliary container to make it vaporize, a storage container communicated with the auxiliary container and storing the liquid, and a liquid draining means for draining liquid in the auxiliary container into the storage container when the internal pressure of the auxiliary container becomes a first predetermined pressure or more.

10 Claims, 5 Drawing Sheets

EXTERNAL COMBUSTION ENGINE

BACKGROUND OF THE INVENTION

1. Field of the Invention

The present invention relates to an external combustion engine using the change of volume of a working fluid accompanying generation and liquefaction of steam of the working fluid to cause displacement of a liquid part of the working fluid and converting this to mechanical energy for output.

2. Description of the Related Art

In the past, this type of external combustion engine was described in Japanese Unexamined Patent Publication No. 2007-255259. In this prior art, the average pressure of the internal pressure of the main container was made to approach a target pressure for the purpose of improving the output and efficiency of the external combustion engine.

Explaining this in brief, liquid is sealed in an auxiliary container separate from the main container in which the working fluid is sealed, this auxiliary container and main container are communicated through a venturi means, and the liquid in the auxiliary container is heated by an auxiliary heater to vaporize it.

The auxiliary container and the auxiliary heater are configured so that the internal pressure of the auxiliary container becomes close to the target pressure. Due to this, the average pressure of the internal pressure of the main container is made to change tracking the internal pressure of the auxiliary container and the average pressure of the internal pressure of the main container is made to approach the target pressure.

According to this prior art, it is possible to maintain the average pressure of the internal pressure of the main container at substantially the target pressure without using a control device or various types of sensors etc., so the output and efficiency of the external combustion engine can be improved by a simplified configuration.

SUMMARY OF THE INVENTION

The inventors studied using the high temperature exhaust gas of another heat engine (for example, an automobile engine) as a heat source of the auxiliary heater so as to raise the efficiency of energy utilization.

In this studied comparative example, for example, when the other heat engine is being operated in its maximum output state etc., the temperature of the exhaust gas becomes extremely high. As a result, the temperature of the auxiliary heater ends up excessively rising beyond the normally envisioned temperature. When the internal pressure of the auxiliary container also ends up excessively rising beyond the normally envisioned pressure, measures have to be taken to prevent the auxiliary container etc. from breaking.

Even when using something other than the exhaust gas of another heat engine as the heat source of the auxiliary heater (for example, a heating element etc.), a similar situation occurs if the temperature of the heat source of the auxiliary heater becomes extremely high and the temperature of the auxiliary heater excessively rises.

The present invention was made in consideration of the above problem and has as its object the suppression of the rise of the internal pressure of the auxiliary container in emergencies when the temperature of the auxiliary heater excessively rises.

To achieve the above object, in the invention as set forth in claim 1, there is provided an external combustion engine provided with a main container in which a working fluid is sealed flowable in a liquid phase state, a heater heating part of the liquid phase state working fluid in the main container to make it vaporize, a cooler cooling steam of the working fluid heated and vaporized by the heater so as to make it liquefy, an output part converting displacement of the liquid part of the working fluid caused by a change of volume of the steam into mechanical energy and outputting the energy, an auxiliary container communicated with the main container through a venturi means and having a liquid sealed inside it, an auxiliary heater heating the liquid in the auxiliary container to make it vaporize, a storage container communicated with the auxiliary container and storing the liquid, and a liquid draining means for draining liquid in the auxiliary container into the storage container when the internal pressure of the auxiliary container becomes a first predetermined pressure or more.

According to this, by draining the liquid in the auxiliary container into the storage container, the internal pressure of the auxiliary container can be lowered, so at times of emergencies where the temperature of the auxiliary heater excessively rises, a rise of the internal pressure of the auxiliary container can be suppressed.

Note that, "the internal pressure of the auxiliary container becomes a first (second) predetermined pressure or more (or less)" in the present invention includes in meaning when the differential pressure between the internal pressure of the auxiliary container and the internal pressure of the storage container becomes a first (second) predetermined pressure or more (or less).

In the invention as set forth in claim 2, there is provided the external combustion engine as set forth in claim 1, wherein the auxiliary container and the storage container are communicated via a first valve, the first valve opens when the internal pressure of the auxiliary container becomes a first predetermined pressure or more, and the liquid draining means is the first valve.

In the invention as set forth in claim 3, there is provided the external combustion engine as set forth in claim 2, wherein the auxiliary container and the storage container are communicated via a first pipe, the first valve is arranged in the first pipe, and an end of the first pipe at the auxiliary container side is arranged to be lower than a level of a liquid in the auxiliary container.

In the invention as set forth in claim 4, there is provided the external combustion engine as set forth in claim 1, further provided with a liquid returning means for returning the liquid in the storage container to the auxiliary container when the internal pressure of the auxiliary container becomes a second predetermined pressure which is smaller than first predetermined pressure, or less.

Due to this, after the liquid draining means drains the liquid from the auxiliary container to the storage container, the liquid can be easily returned from the storage container to the auxiliary container.

In the invention as set forth in claim 5, there is provided the external combustion engine as set forth in claim 4, wherein the auxiliary container and the storage container are communicated via a second valve, the second valve opens when the internal pressure of the auxiliary container becomes a second predetermined pressure or less, and the liquid returning means is the second valve.

In the invention as set forth in claim 6, there is provided the external combustion engine as set forth in claim 5, wherein the auxiliary container and the storage container are communicated via a second pipe, the second valve is arranged in the second pipe, and an end of the second pipe at the storage container side is arranged to be lower than a level of the liquid in the storage container.

In the invention as set forth in claim 7, there is provided the external combustion engine as set forth in claim 5, wherein the auxiliary container and the storage container are communicated via a second pipe, the second valve is arranged in the second pipe, an end of the second pipe at the storage container side is arranged to be lower than a level of the liquid in the storage container, and the second pipe as a whole is arranged lower than the first pipe.

In the invention as set forth in claim 8, there is provided the external combustion engine as set forth in claim 1, wherein the storage container is opened to the atmosphere.

In the invention as set forth in claim 9, there is provided the external combustion engine as set forth in claim 1, wherein the storage container is sealed and gas is sealed in the storage container.

In the invention as set forth in claim 10, there is provided the external combustion engine as set forth in claim 9, wherein the storage container is formed by a soft bag deforming due to the differential pressure between the inside and outside.

Due to this, when the amount of the liquid in the storage container fluctuates, the inside volume of the storage container changes in accordance with the fluctuations in the amount of liquid, so it is possible to suppress fluctuations in the internal pressure of the storage container accompanying fluctuations in the amount of liquid in the storage container. Further, by forming the storage container by a soft bag, it is possible to change the inside volume of the storage container.

BRIEF DESCRIPTION OF THE DRAWINGS

These and other objects and features of the present invention will become clearer from the following description of the preferred embodiments given with reference to the attached drawings, wherein.

DESCRIPTION OF THE PREFERRED EMBODIMENTS

First Embodiment

Figure 1:
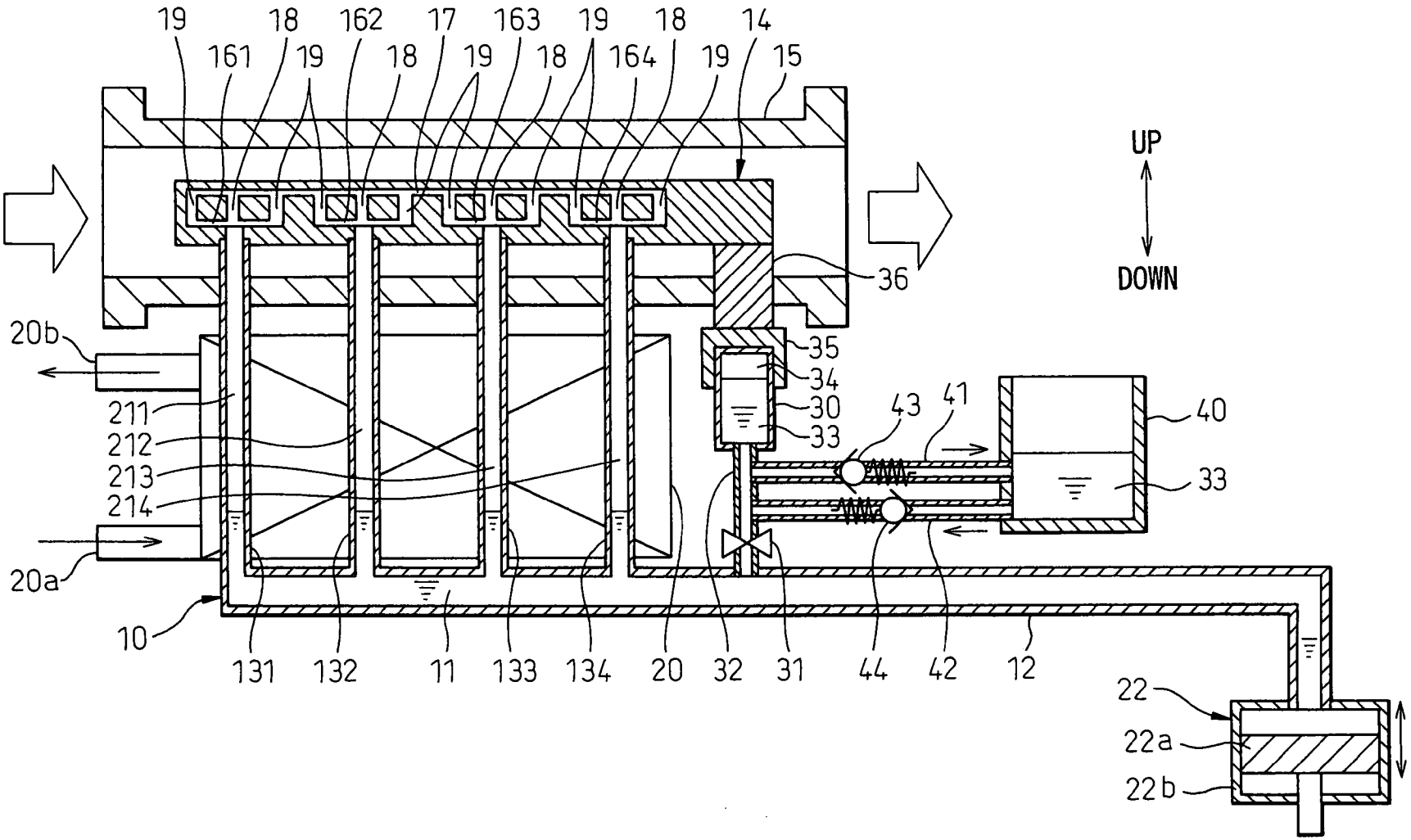
FIG. 1 is a schematic view of an electric power generation system showing a first embodiment of the present invention.

Below, a first embodiment of the present invention will be explained based on FIG. 1 to FIG. 3. The external combustion engine of the present invention is also called a "liquid piston type steam engine". This embodiment applies the external combustion engine of the present invention to a drive source of an electric power generation system mounted in an automobile. FIG. 1 is a view of the configuration showing the schematic configuration of an external combustion engine in the present embodiment. The up and down arrows at the top of FIG. 1 show the up-down directions in the mounted state of the external combustion engine.

The main container 10 is a pipe-shaped pressure container in which the working fluid (in the present embodiment, water) 11 is sealed flowable in the liquid phase state. The main container 10 has one merging pipe 12 positioned at one end side of the main container 10 and a plurality of (four in the present embodiment) branch pipes 131 to 134 branching from the merging pipe 12 at the other end side of the main container 10.

In the present embodiment, the merging pipe 12 and branch pipes 131 to 134 are made from stainless steel. In the present embodiment, the cross-sectional shapes of the flow paths of the merging pipe 12 and branch pipes 131 to 134 are circular. The invention is not necessarily limited to circular shapes and may also be non-circular shapes.

The part of the merging pipe 12 where the branch pipes 131 to 134 are connected extends in the horizontal direction. The branch pipes 131 to 134 extend upward from the merging pipe 12. The top ends of the branch pipes 131 to 134 are connected by a heater 14 exchanging heat of the working fluid 11 with exhaust gas (high temperature gas) of another heat engine (in the present embodiment, the automobile engine) to heat the working fluid 11. The heater 14 forms part of the main container 10. In the present embodiment, it is formed from copper superior in heat conductivity.

The heater 14 is arranged in gas pipe 15 through which the exhaust gas flows. Inside the heater 14, hollow parts are formed communicating with the four branch pipes 131 to 134. Parts of the hollow parts form heating portions 161 to 164 heating part of the liquid phase state working fluid 11 to evaporate. These heating portions 161 to 164 are four disk-shaped spaces provided corresponding to the branch pipes 131 to 134 and are arranged coaxially with the branch pipes 131 to 134.

Among the hollow parts inside the heater 14, the parts positioned above the heating portions 161 to 164 form a steam reservoir 17 storing the steam of the working fluid 11 generated at the heating portions 161 to 164.

The steam reservoir 17 extends in parallel to the direction of arrangement of the heating portions 161 to 164 (left-right direction of FIG. 1) and is communicated through communicating paths 18 and 19 to heating portions 161 to 164. The communicating paths 18 extend from the centers of the disk-shaped heating portions 161 to 164 upward, while the communicating paths 19 extend from the outer circumferential parts of the disk-shaped heating portions 161 to 164 upward.

The steam reservoir 17 has a gas sealed in it as an additional medium in exactly a predetermined volume. As the additional medium, it is possible to select a medium for maintaining a gas phase state under the operating conditions of the external combustion engine. The gas used as the additional medium may for example be the easily handling air and may be pure steam of the working fluid 11.

While not shown, for molding purposes, the heater 14 is molded split into a plurality of parts, then the plurality of split parts are fastened together by screws or other fastening means. At this time, the seal can be secured by arranging seal members between the plurality of split parts. It is also possible to join the plurality of split parts together by welding, brazing, or other connecting means.

The branch pipes 131 to 134 are arranged so as to run through the inside of a cooler 20 in which cooling water is circulated. The parts of the branch pipes 131 to 134 positioned in the cooler 20 form cooling portions 211 to 214 cooling the working fluid 11 evaporated at the heating portions 161 to 164 and making it condense. By cooling water circulating through the cooler 20, the cooling portions 211 to 214 are cooled, and the cooling portions 211 to 214 cool the working fluid 11.

A cooling water inlet 20*a* and a cooling water outlet 20*b* of the cooler 20 are connected to a circulation circuit of the cooling water. Inside the circulation circuit of the cooling water, a radiator (not shown) is arranged. Due to this, heat which the cooling water robs from the steam of the working fluid 11 is radiated by the radiator to the atmosphere.

The external combustion engine of the present embodiment is mounted in an automobile, so heat which the cooling water robs from the steam of the working fluid 11 can be utilized for warming up the automobile engine or utilized as the heat source for a heat core of an automobile air-conditioning system. The parts of the branch pipes 131 to 134 which form the cooling portions 211 to 214 may be formed from the superior heat conductivity copper.

The end part of the main container 10 at the merging pipe 12 side is communicated with an output part 22. In the case of the present embodiment, the main container 10 is bent at its intermediate part (merging pipe 12) into an L-shape. The end of the main container 10 at the merging pipe 12 side is directed downward. The end part of the main container 10 at the merging pipe 12 side may also be directed upward or in the horizontal direction.

The output part 22 is provided with a piston 22*a* displacing upon receiving pressure from the liquid phase part of the working fluid 11, a cylinder 22*b* slidably supporting the piston 22*a*, and a coil spring (not shown) generating an elastic force pressing the piston 22*a* to the main container 10 side (upward in FIG. 1). Instead of a coil spring, a crank and flywheel may also be used.

Next, the operation in the above basic configuration will be simply explained. First, if the working fluid (water) 11 in the heating portions 161 to 164 is heated and evaporates, high temperature, high pressure steam of the working fluid 11 is stored in the steam reservoir 17 and in the heating portions 161 to 164 and pushes down the levels of the working fluid 11 in the branch pipes 131 to 134.

This being the case, the liquid phase part of the working fluid 11 is pushed out from the heating portion 161 to 164 side to the output part 22 side and the piston 22*a* of the output part 22 is pushed down (first stroke). At this time, the piston 22*a* elastically compresses the not shown coil spring.

Next, the levels of the working fluid 11 in the branch pipes 131 to 134 fall to the cooling portions 211 to 214. If steam of the working fluid enters the cooling portions 211 to 214, the steam of the working fluid 11 is cooled and condensed by the cooling portions 211 to 214.

For this reason, the force pushing down the level of the working fluid 11 is cancelled and the force pushing down the piston 22*a* is cancelled. The once pushed down piston 22*a* at the output part 22 side rises due to the elastic spring back force of the not shown coil spring, the liquid phase part of the working fluid 11 is pushed back from the output part 22 side toward the heating portion 161 to 164 side, and the level of the working fluid 11 rises to the heating portions 161 to 164 (second stroke).

When using a crank and flywheel instead of the coil spring, the pushed down piston 22*a* at the output part 22 side rises due to inertia of the flywheel, the liquid phase part of the working fluid 11 is pushed back from the output part 22 side toward the heating portion 161 to 164 side, and the level of the working fluid 11 rises to the heating portions 161 to 164.

By repeating such an operation (first stroke and second stroke), the liquid phase part of the working fluid 11 in the main container 10 cyclically displaces (so-called "self vibration") and makes the piston 22*a* of the output part 22 cyclically move up and down.

That is, the working fluid 11 is alternately repeatedly evaporated and condensed whereby the steam of the working fluid 11 changes in volume. Due to this, the liquid phase part of the working fluid 11 appears to displace like a piston. This displacement of the liquid phase part of the working fluid 11 is converted to mechanical energy and output at the output part 22.

Next, the configuration for adjusting the internal pressure of the main container 11 will be explained. The auxiliary container 30 is communicated with the main container 11 via a venturi means 31. In the present embodiment, the auxiliary container 30 is arranged above the merging pipe 12, the bottom part of the auxiliary container 30 and the merging pipe 12 are connected by pipe 32, and the venturi means 31 is formed in the pipe 32.

Due to the venturi means 31, the internal pressure of the auxiliary container 30 (hereinafter referred to as "the auxiliary container inside pressure") does not cyclically fluctuate following the internal pressure of the main container 11, but stabilizes at a pressure substantially equal to the average value of the internal pressure of the main container 11 (hereinafter referred to as the "average pressure in the main container"). In the present embodiment, as the venturi means 31, a fixed venturi of a reduced diameter of the passage is used.

In the present embodiment, the auxiliary container 30 and pipe 32 are made of stainless steel. The inside volume of the auxiliary container 30 is smaller than the inside volume of the main container 11. Inside the auxiliary container 30, a liquid 33 and a gas 34 are sealed. It is also possible to fill the inside of the auxiliary container 30 with just a liquid 33.

In the present embodiment, as the liquid 33, a liquid the same as the working fluid 11 (in the present embodiment, water) is used. When using a liquid different from the working fluid 11 as the liquid 33, in the present embodiment, since the auxiliary container 30 is arranged above the merging pipe 12, it is preferable to use a liquid with a smaller specific gravity than the working fluid 11.

As the gas 34, it is preferable to use a gas exhibiting poor solubility in the working fluid 11. As the gas 34 in the present embodiment, helium, which exhibits poor solubility in water, is used.

An auxiliary heater 35 for heating and vaporizing the liquid 33 in the auxiliary container 30 is arranged so as to cover the top of the auxiliary container 30. This auxiliary heater 35 is connected to be able to conduct heat with the heater 14. Specifically, the auxiliary heater 35 and the heater 14 are connected through a connection member 36 formed from a superior heat conductivity material (for example, copper).

Due to this, the auxiliary heater 35 is heated by heat conducted from the heater 14, so the auxiliary heater 35 can heat the auxiliary container 30 and can heat the liquid 33 in the auxiliary container 30.

Figure 2:
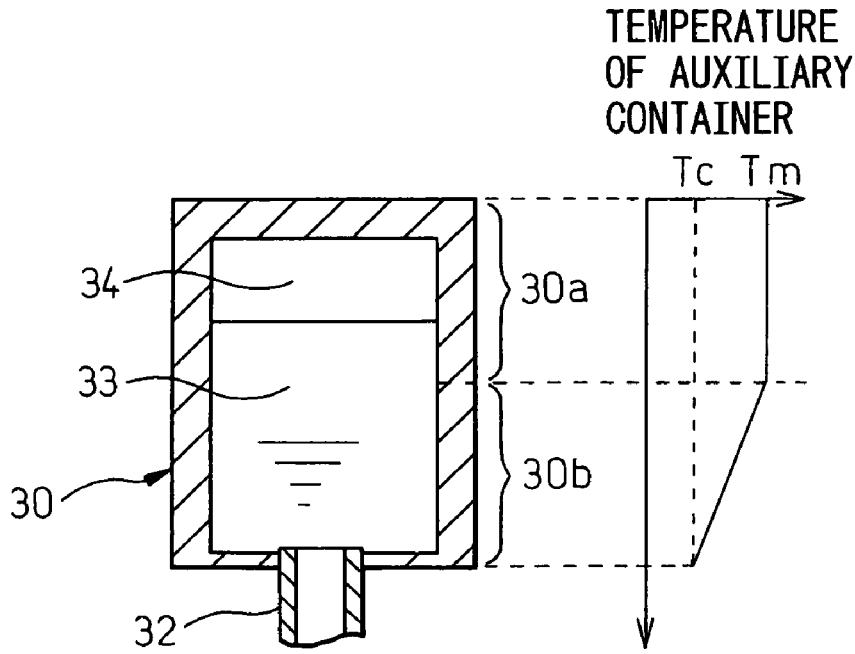
FIG. 2 is a graph showing a temperature gradient in an auxiliary container of FIG. 1.

FIG. 2 is a graph showing the temperature gradient of the auxiliary container 30 when the auxiliary container 30 is heated. As shown in FIG. 2, the auxiliary container 30 is provided with a heat conducting structure where, at a top high temperature part 30*a*, the temperature gradient is small enough to be ignored and, at the bottom low temperature part 30*b*, a temperature gradient is formed where the temperature falls the further from the high temperature part 30*a*.

In FIG. 2, the temperature Tm is the temperature of the high temperature part 30*a* (below, this temperature called the "high temperature part temperature"). The temperature Tc is the temperature at the bottom end of the low temperature part 30*b* (below, this temperature called the "low temperature part temperature"). This low temperature part temperature Tc is a temperature substantially the same as the temperature of the cooling portions 211 to 214 (more accurately is a temperature slightly higher than the temperature of the cooling portions 211 to 214). Therefore, the low temperature part temperature Tc is a temperature of the boiling point of the liquid 33 or less.

Figure 3:
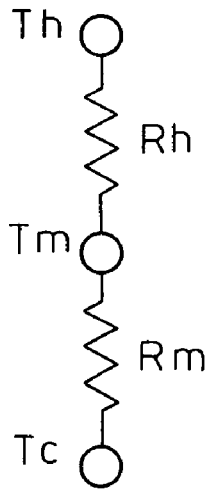
FIG. 3 is a view of a heat resistance model of an auxiliary container of FIG. 1.

FIG. 3 shows a heat resistance model in the auxiliary container 30. In FIG. 3, Th is the temperature of the heater 14, Rh is the heat resistance between the heater 14 and the high temperature part 30*a* of the auxiliary container 30, and Rm is the heat resistance between the high temperature part 30*a* of the auxiliary container 30 and the bottom end of the low temperature part 30*b* (outlet part of auxiliary container 30).

As will be understood from FIG. 3, the auxiliary container 30 has a structure having heat resistance such that, if heated by the auxiliary heater 35, the high temperature part temperature Tm becomes lower than the temperature Th of the heater 14 and higher than the low temperature part temperature Tc ($Tc<Tm<Th$).

Further, the auxiliary container 30 is heated by the heat conducted from the heater 14, so the high temperature part temperature Tm becomes smaller than the temperature T1 of the heating portions 161 to 164 of the main container 11 (below, called the "heating portion temperature"). On the other hand, as explained above, the low temperature part temperature Tc is a temperature slightly higher than the temperature T2 of the cooling portions 211 to 214 (below, called the "cooling portion temperature"). For this reason, the high temperature part temperature Tm becomes lower than the heating portion temperature T1 and higher than the cooling portion temperature T2 ($T2<Tm<T1$).

As shown in FIG. 1, the storage container 40 storing the liquid 33 is communicated with the auxiliary container 30 through the first and second pipes 41 and 42. The storage container 40 is a container having a certain degree of rigidity (for example, a plastic container etc.). The internal pressure of the storage container 40 is about the atmospheric pressure. In the present embodiment, the storage container 40 is opened to the atmosphere, so the internal pressure of the storage container 40 becomes the same as the atmospheric pressure.

The first and second pipes 41 and 42 are arranged in parallel. In the present embodiment, the second pipe 42 as a whole is arranged below the first pipe 41. The first pipe 41 is a pipe for draining the liquid 33 in the auxiliary container 30 to the storage container 40. Inside the first pipe 41, a first valve (liquid draining means) 43 is arranged.

The second pipe 42 is a pipe for returning the liquid drained from the auxiliary container 30 through the first pipe 41 to the storage container 40, to the auxiliary container 30. In the second pipe 42, a second valve (liquid returning means) 44 is arranged. In the present embodiment, one-way valves are used as the first and second valves 43 and 44.

The first valve 43 opens when the differential pressure between the auxiliary container inside pressure and the internal pressure of the storage container 40 becomes a first predetermined pressure $\Delta P1$ or more. Here, the first predetermined pressure $\Delta P1$ is a pressure greater than the later explained target pressure. The second valve 44 opens when the differential pressure between the auxiliary container inside pressure and the internal pressure of the storage container 40 becomes a second predetermined pressure $\Delta P2$ smaller than the first predetermined pressure $\Delta P1$ or less.

The ends of the first and second pipes 41 and 42 at the auxiliary container 30 sides are arranged below the level of the liquid 33 in the auxiliary container 30. In the present embodiment, the ends of the first and second pipes 41 and 42 at the auxiliary container 30 sides are arranged in a pipe 32 connecting the bottom of the auxiliary container 30 and the merging pipe 12.

The ends of the first and second pipes 41 and 42 at the storage container 40 sides are arranged below the level of the liquid 33 in the storage container 40. In the present embodiment, the ends of the first and second pipes 41 and 42 at the storage container 40 sides are arranged at the bottom part of the storage container 40.

Next, the operation for adjusting the internal pressure of the main container 11 by the above configuration will be explained. If heat conducted from the heater 14 causes the liquid 33 in the high temperature part 30*a* to be heated and vaporized, steam at high temperature and high pressure is stored at the high temperature part 30*a*. The auxiliary container 30 is configured so that, at this time, the level of the liquid 33 will not be pushed down to the low temperature part 30*b*, but will be positioned in the high temperature part 30*a*.

Due to this, the liquid 33 continues to contact the high temperature part 30*a*, so the liquid 33 in the auxiliary container 30 is maintained in the boiling state. For this reason, the auxiliary container inside pressure can be maintained at the same pressure as the saturated steam pressure of the liquid 33 in the high temperature part temperature Tm.

The above-mentioned heat resistance Rh and heat resistance Rm are set so that when making the temperature of the liquid 33 in the case where the saturated steam pressure of the liquid 33 becomes equal to the target value of the average pressure in the main container (below, referred to as the "target pressure") the target temperature, the high temperature part temperature Tm becomes substantially equal to the target temperature. For this reason, the auxiliary container inside pressure becomes substantially equal to the target pressure. In other words, the auxiliary container 30, auxiliary heater 35, and connection member 36 are configured so that the internal pressure of the auxiliary container 30 becomes substantially the target pressure.

Due to this, the internal pressure of the auxiliary container 30 is maintained at substantially the target pressure, so the average pressure in the main container changes tracking the auxiliary container inside pressure and approaches the target pressure. As a result, even if the heating portion temperature T1 fluctuates, it is possible to maintain the average pressure in the main container at substantially the target pressure, so it is possible to prevent a drop in the performance (output and efficiency) due to fluctuations in the heating portion temperature T1.

The operation for adjusting the internal pressure of the main container 11 described here was the operation in the state where the temperature of the auxiliary heater 35 was the normally envisioned temperature (normal state).

However, when, for example, the temperature of the exhaust gas becomes extremely high like when the automobile engine is operating in its maximum output state, the temperature of the auxiliary heater 35 will excessively rise beyond the normally envisioned temperature. In this case, the high temperature part temperature Tm and low temperature part temperature Tc of the auxiliary container 30 will end up excessively rising beyond the normally envisioned temperature and the auxiliary container inside pressure will also end up excessively rising beyond the normally envisioned pressure.

In the present embodiment, in emergencies where the temperature of the auxiliary heater 35 excessively rises, when the differential pressure between the auxiliary container inside pressure and the internal pressure of the storage container 40 becomes a first predetermined pressure $\Delta P1$ or more, the first valve 43 opens, so the liquid 33 in the auxiliary container 30 drains to the storage container 40. For this reason, the auxiliary container inside pressure can be lowered.

Further, when the differential pressure between the auxiliary container inside pressure and the internal pressure of the storage container 40 becomes a second predetermined pressure ΔP2 smaller than the first predetermined pressure ΔP1 or less, the second valve 44 opens, so the liquid 33 drained from the auxiliary container 30 to the storage container 40 can be returned to the auxiliary container 30.

Due to the above, in emergencies where the temperature of the auxiliary heater 35 excessively rises, a rise in the auxiliary container inside pressure can be suppressed. As a result, it is possible to prevent the auxiliary container 30 etc. from breaking due to the rise in the auxiliary container inside pressure.

Showing an example of settings of the first and second predetermined pressure ΔP1, ΔP2, in this example, the auxiliary container inside pressure is usually 1 MPa or so, so the first predetermined pressure ΔP1 is set to 1.5 MPa (ΔP1=1.5 MPa). That is, the first valve 43 opens when the auxiliary container inside pressure becomes 1.5 MPa or more higher than the internal pressure of the storage container 40.

Further, the second predetermined pressure ΔP2 is set to −0.05 MPa (ΔP2=−0.05 MPa). That is, the second valve 44 opens when the auxiliary container inside pressure becomes 0.05 MPa or more lower than the internal pressure of the storage container 40.

Therefore, in this example, when the temperature of the auxiliary container 30 becomes extremely high, the first valve 43 opens, and the liquid 33 in the auxiliary container 30 is drained to the storage container 40, and the heating of the auxiliary container 30 by the auxiliary heater 35 is stopped (specifically, the automobile engine is stopped). When the auxiliary container inside pressure falls to the internal pressure of the storage container 40 or less, the second valve 44 opens, and the liquid 33 in the storage container 40 is returned to the auxiliary container 30.

As another example of setting, the second predetermined pressure ΔP2 may also be set to about 1 MPa of course (ΔP2=1 MPa).

Second Embodiment

Figure 4:
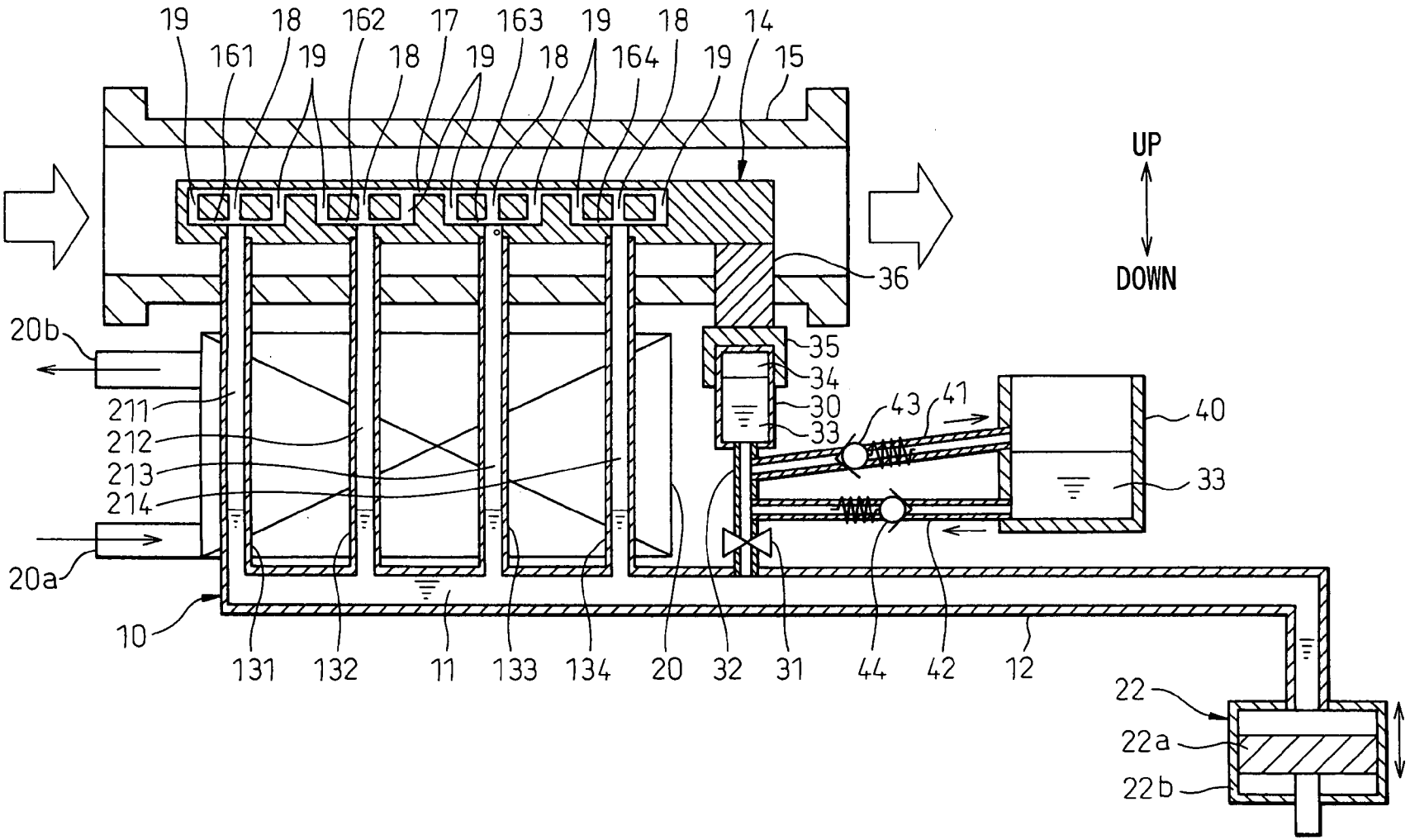
FIG. 4 is a schematic view of an electric power generation system showing a second embodiment of the present invention.

In the first embodiment, the ends of the first and second pipes 41 and 42 at the storage container 40 sides were arranged below the level of the liquid 33 in the storage container 40. On the other hand, in the second embodiment, as shown in FIG. 4, the end of the first pipe 41 at the storage container 40 side is arranged higher than the level of the liquid 33 in the storage container 40.

In the present embodiment as well, it is possible to obtain actions and effects similar to the first embodiment. According to the present embodiment, the end of the first pipe 41 at the storage container 40 side is arranged at the top part of the storage container 40. Due to this, even if an obstruction in the pipe layout makes it impossible to arrange the end of the first pipe 41 at the storage container 40 side at the bottom part of the storage container 40, the first pipe 41 can be arranged without hindrance.

As a modification of the present embodiment, it is also possible to arrange the end of the second pipe 42 at the auxiliary container 30 side above the level of the liquid 33 in the auxiliary container 30. According to this modification, it is possible to arrange the end of the second pipe 42 at the auxiliary container 30 side in the auxiliary container 30. Even if an obstruction in the pipe layout makes it impossible to arrange the end of the second pipe 42 at the auxiliary container 30 side at the pipe between the auxiliary container 30 and the merging pipe 12, the second pipe 42 can be arranged without hindrance.

Third Embodiment

Figure 5:
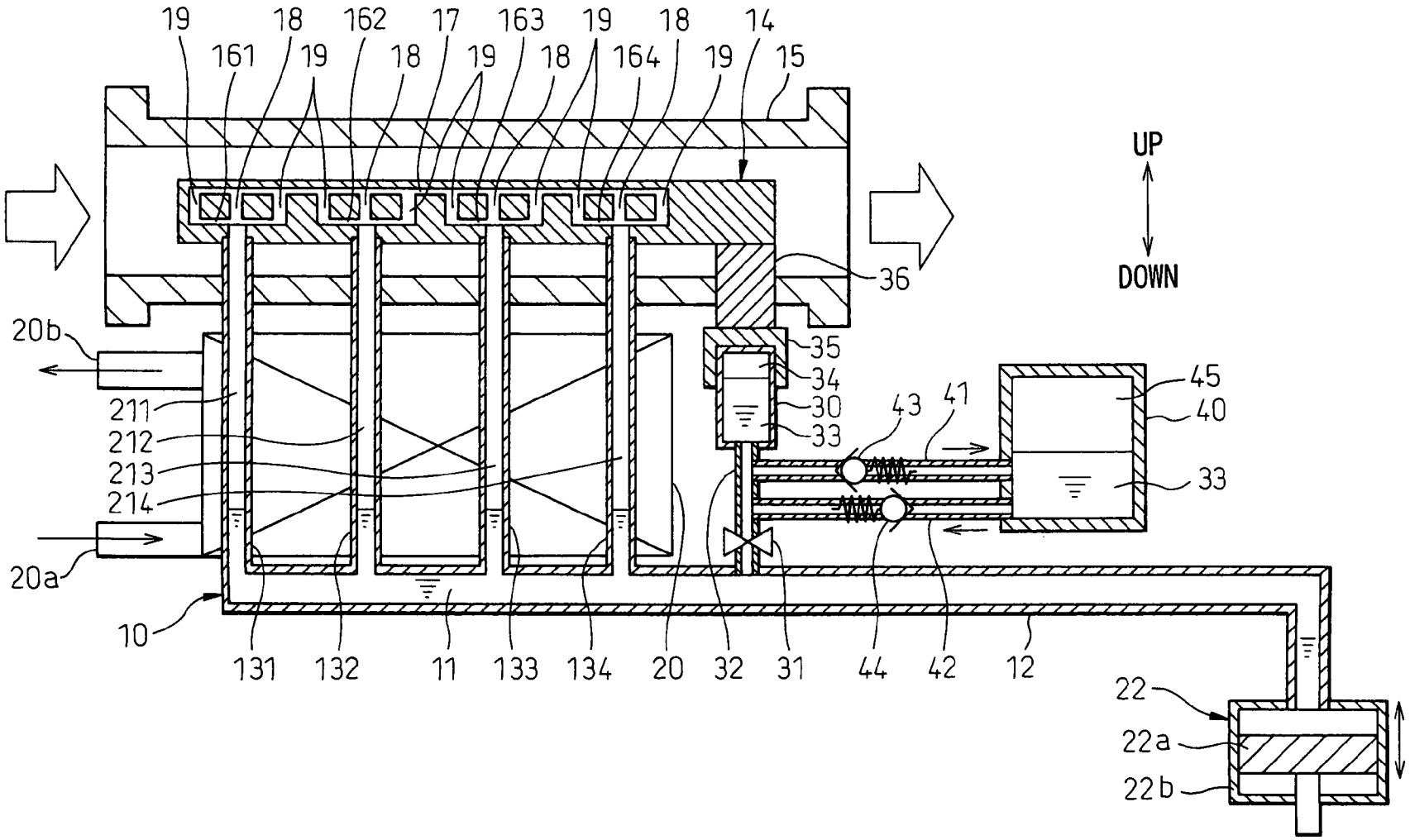
FIG. 5 is a schematic view of an electric power generation system showing a third embodiment of the present invention.

In the first embodiment, the storage container 40 was opened to the atmosphere to make the internal pressure of the storage container 40 the same as the atmospheric pressure. On the other hand, in the present third embodiment, as shown in FIG. 5, the storage container 40 is sealed and the liquid 33 and the gas 45 are sealed in the storage container 40.

According to the present embodiment, by setting the sealed volumes of the liquid 33 and gas 45, it is possible to freely set the internal pressure of the storage container 40. For this reason, for example, by setting the internal pressure of the storage container 40 somewhat higher than the atmospheric pressure, it is possible to increase the amount of flow of the liquid 33 from the inside of the storage container 40 to the auxiliary container 30 when the second valve 44 opens and shorten the time required for returning the liquid 33.

Fourth Embodiment

Figure 6:
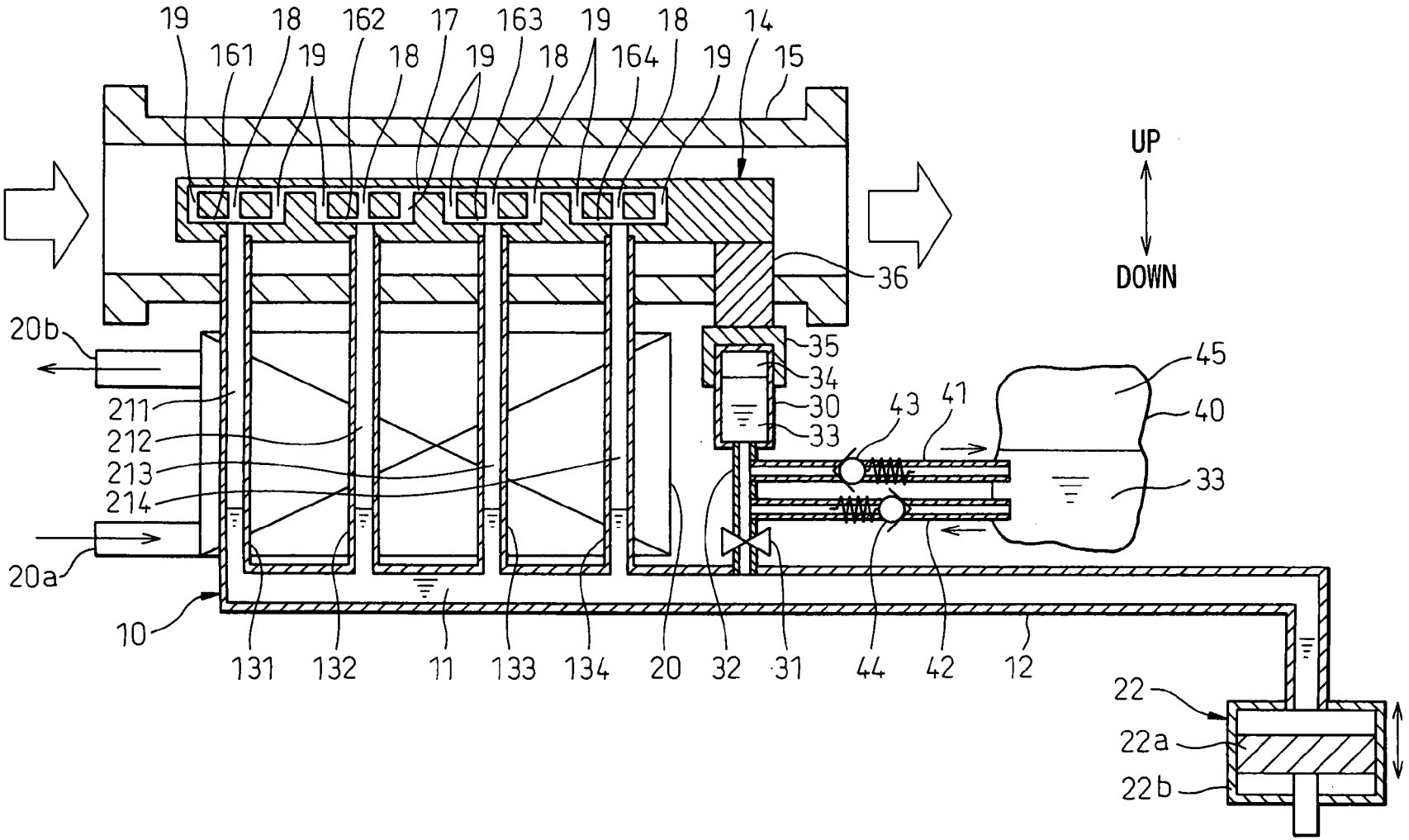
FIG. 6 is a schematic view of an electric power generation system showing a fourth embodiment of the present invention.

In the third embodiment, the storage container 40 was formed by a plastic container etc. having a certain degree of rigidity, so the inside volume of the storage container 40 was constant. On the other hand, in the fourth embodiment, as shown in FIG. 6, the storage container 40 is formed by a soft bag which deforms due to the pressure difference of the inside and outside (for example, a plastic bag etc.), so the inside volume of the storage container 40 changes.

According to the third embodiment, the inside volume of the storage container 40 was constant, so movement of liquid 33 between the auxiliary container 30 and the storage container 40 caused the internal pressure of the storage container 40 to fluctuate. That is, if the liquid 33 in the auxiliary container 30 drains to the storage container 40, the internal pressure of the storage container 40 rises, while if the liquid 33 returns from the storage container 40 to the auxiliary container 30, the internal pressure of the storage container 40 falls.

For this reason, the amount of the liquid 33 in the storage container 40 causes the pressure difference between the auxiliary container inside pressure and the internal pressure of the storage container 40 to change, so there was the possibility of the reliability of the operations of the first and second valves 43 and 44 falling somewhat.

As opposed to this, according to the fourth embodiment, if the liquid 33 in the auxiliary container 30 drains to the storage container 40, the storage container 40 formed by the soft bag swells and the inside volume of the storage container 40 increases. Due to this, a rise of the internal pressure of the storage container 40 is suppressed. If the liquid 33 returns from the storage container 40 to the auxiliary container 30, the storage container 40 shrinks. By the reduction in the volume of the storage container 40, the drop in the internal pressure of the storage container 40 is suppressed.

For this reason, fluctuation of the internal pressure of the storage container 40 caused by the fluctuations in the amount of the liquid 33 in the storage container 40 can be suppressed, so the first and second valves 43 and 44 can be reliably operated based on the differential pressure between the auxiliary container inside pressure and the internal pressure of the storage container 40.

According to the present embodiment, the storage container 40 is formed by a soft bag, so the atmospheric pressure can be utilized to change the internal volume of the storage container 40. For this reason, the configuration can be simplified compared with the case of using a mechanical mechanism to change the internal volume of the storage container 40.

Other Embodiments

In the above embodiments, as the first and second valves 43 and 44, one-way valves were used and the differential pressure between the auxiliary container inside pressure and the internal pressure of the storage container 40 was used to make the first and second valves 43 and 44 open. On the other hand, it is also possible to use solenoid valves as the first and second valves 43 and 44 and provide the auxiliary container 30 with a pressure sensor for detecting the auxiliary container inside pressure. In this case, if the auxiliary container inside pressure detected by the pressure sensor becomes the first predetermined pressure or more, the first valve 43 opens. Further, the second valve 44 may also be opened when the auxiliary container inside pressure detected by the pressure sensor falls to the second predetermined pressure or less. Instead of the first and second valves 43 and 44, it is also possible to use a power pump etc. to drain and return the liquid 33.

In the above embodiments, the storage container 40 and the auxiliary container 30 are connected through first and second pipes 41 and 42. On the other hand, it is also possible to eliminate the first and second pipes 41 and 42, arrange the storage container 40 and the auxiliary container 30 adjoining each other, and connect the two.

In the above embodiments, the exhaust gas of another heat engine is used as the heat source of the heater 14 and auxiliary heater 35. On the other hand, it is of course also possible to use something other than the exhaust gas of another heat engine as the heat source of the heater 14 and auxiliary heater 35 (for example, a heating element etc.)

Further, the basic configuration of the external combustion engine in the embodiments is only shown as an example. The invention is not limited to this. The basic configuration of the external combustion engine of the present invention can be modified in various ways as shown in, for example, FIG. 14 to FIG. 25 of Japanese Unexamined Patent Publication No. 2007-255259.

In the above embodiments, the case of applying the present invention to a drive source of an electric power generation system mounted in an automobile was explained, but the external combustion engine of the present invention can also be utilized as a drive source for something other than an electric power generation system mounted in an automobile.

While the invention has been described with reference to specific embodiments chosen for purpose of illustration, it should be apparent that numerous modifications could be made thereto by those skilled in the art without departing from the basic concept and scope of the invention.

The invention claimed is:

1. An external combustion engine provided with:

a main container in which a working fluid is sealed flowable in a liquid phase state, a heater heating part of the liquid phase state working fluid in the main container to make it vaporize, a cooler cooling steam of the working fluid heated and vaporized by the heater so as to make it liquefy, an output part converting displacement of the liquid part of the working fluid caused by a change of volume of the steam into mechanical energy and outputting the energy, an auxiliary container communicated with the main container through a venturi means and having a liquid sealed inside it, an auxiliary heater heating the liquid in the auxiliary container to make it vaporize, a storage container communicated with the auxiliary container and storing said liquid, and means for draining liquid in the auxiliary container into the storage container when the internal pressure of the auxiliary container becomes a first predetermined pressure or more; wherein the auxiliary container further comprises a low temperature part having a temperature lower than the boiling point of the liquid and a high temperature part having a temperature higher than the low temperature part temperature and lower than a temperature of the heater, and the auxiliary container is configured so that an internal pressure thereof is maintained at the same pressure as the saturated steam pressure of the liquid at the high temperature part temperature, and wherein the first predetermined pressure is set to be the saturated steam pressure at which the high temperature part temperature rises beyond a normally envisioned temperature.

2. An external combustion engine as set forth in claim 1, wherein the auxiliary container and the storage container communicate via a first valve, the first valve opens when the internal pressure of the auxiliary container becomes a first predetermined pressure or more, and the draining means is the first valve.

3. An external combustion engine as set forth in claim 2, wherein the auxiliary container and the storage container communicate via a first pipe, the first valve is arranged in the first pipe, and an end of the first pipe at the auxiliary container side is arranged to be lower than a level of a liquid in the auxiliary container.

4. An external combustion engine as set forth in claim 1, further comprising means for returning the liquid in the storage container to the auxiliary container when the internal pressure of the auxiliary container becomes a second predetermined pressure which is smaller than first predetermined pressure, or less.

5. An external combustion engine as set forth in claim 4, wherein the auxiliary container and the storage container communicate via a second valve, the second valve opens when the internal pressure of the auxiliary container becomes a second predetermined pressure or less, and the returning means is the second valve.

6. An external combustion engine as set forth in claim 5, wherein the auxiliary container and the storage container communicate via a second pipe, the second valve is arranged in the second pipe, and an end of the second pipe at the storage container side is arranged to be lower than a level of the liquid in the storage container.

7. An external combustion engine as set forth in claim 1, wherein the storage container is opened to the atmosphere.

8. An external combustion engine as set forth in claim 1, wherein the storage container is sealed and gas is sealed in the storage container.

9. An external combustion engine provided with:

a main container in which a working fluid is sealed flowable in a liquid phase state, a heater heating part of the liquid phase state working fluid in the main container to make it vaporize, a cooler cooling steam of the working fluid heated and vaporized by the heater so as to make it liquefy, an output part converting displacement of the liquid part of the working fluid caused by a change of volume of the steam into mechanical energy and outputting the energy, an auxiliary container communicated with the main container through a venturi means and having a liquid sealed inside it, an auxiliary heater heating the liquid in the auxiliary container to make it vaporize, a storage container communicated with the auxiliary container and storing said liquid, means for draining liquid in the auxiliary container into the storage container when the internal pressure of the auxiliary container becomes a first predetermined pressure or more; and a liquid returning means for returning the liquid in the storage container to the auxiliary container when the internal pressure of the auxiliary container becomes a second predetermined pressure which is smaller than first predetermined pressure, or less; wherein the auxiliary container and the storage container are communicated via a second valve, the second valve opens when the internal pressure of the auxiliary container becomes a second predetermined pressure or less, the liquid returning means is the second valve;

the auxiliary container and the storage container communicate via a second pipe, the second valve is arranged in the second pipe, an end of the second pipe at the storage container side is arranged to be lower than a level of the liquid in the storage container, and the second pipe as a whole is arranged lower than the first pipe.

10. An external combustion engine provided with:

a main container in which a working fluid is sealed flowable in a liquid phase state, a heater heating part of the liquid phase state working fluid in the main container to make it vaporize, a cooler cooling steam of the working fluid heated and vaporized by the heater so as to make it liquefy, an output part converting displacement of the liquid part of the working fluid caused by a change of volume of the steam into mechanical energy and outputting the energy, an auxiliary container communicated with the main container through a venturi means and having a liquid sealed inside it, an auxiliary heater heating the liquid in the auxiliary container to make it vaporize, a storage container communicated with the auxiliary container and storing said liquid, and means for draining liquid in the auxiliary container into the storage container when the internal pressure of the auxiliary container becomes a first predetermined pressure or more; wherein the storage container is sealed and gas is sealed in the storage container; and the storage container is formed by a soft bag deforming due to the differential pressure between an inside and an outside of the soft bag.

* * * * *